US012523127B2

(12) United States Patent
Avitia et al.

(10) Patent No.: US 12,523,127 B2
(45) Date of Patent: Jan. 13, 2026

(54) DOWNHOLE SEPARATION SYSTEM

(71) Applicant: HORIZONTAL WIRELINE SERVICES, LLC, Irwin, PA (US)

(72) Inventors: Manuel Avitia, Irwin, PA (US); Joseph Sites, Venetia, PA (US)

(73) Assignee: HORIZONTAL WIRELINE SERVICES, LLC, Irwin, PA (US)

( * ) Notice: Subject to any disclaimer, the term of this patent is extended or adjusted under 35 U.S.C. 154(b) by 0 days.

(21) Appl. No.: 18/670,208

(22) Filed: May 21, 2024

(65) Prior Publication Data

US 2024/0392663 A1 Nov. 28, 2024

Related U.S. Application Data

(60) Provisional application No. 63/504,318, filed on May 25, 2023.

(51) Int. Cl.
*E21B 43/119* (2006.01)
*E21B 43/1185* (2006.01)

(52) U.S. Cl.
CPC ..... *E21B 43/119* (2013.01); *E21B 43/1185* (2013.01)

(58) Field of Classification Search
CPC ..... E21B 17/02; E21B 17/06; E21B 43/119; E21B 43/1185
See application file for complete search history.

(56) References Cited

U.S. PATENT DOCUMENTS

| | | | |
|---|---|---|---|
| 1,243,364 | A | 10/1917 | Walker |
| 2,621,895 | A | 12/1952 | Toelke |
| 4,007,790 | A | 2/1977 | Henning |
| 4,756,363 | A | 7/1988 | Lanmon et al. |
| 5,323,853 | A | 6/1994 | Leismer et al. |
| 5,429,192 | A | 7/1995 | Huber et al. |
| 6,032,733 | A | 3/2000 | Ludwig et al. |
| 6,269,883 | B1 | 8/2001 | Gissler et al. |
| 6,354,379 | B2 | 3/2002 | Miszewski et al. |
| 6,431,269 | B1 | 8/2002 | Post et al. |
| 6,959,765 | B2 | 11/2005 | Bell |
| 7,152,674 | B2 | 12/2006 | Bowles |
| 7,353,871 | B2 | 4/2008 | Hromas et al. |
| 7,373,974 | B2 | 5/2008 | Connell et al. |
| 7,980,310 | B2 | 7/2011 | Stoesz et al. |
| 8,141,634 | B2 | 3/2012 | Fisher et al. |
| 8,215,386 | B2 | 7/2012 | Manke et al. |

(Continued)

FOREIGN PATENT DOCUMENTS

| | | | |
|---|---|---|---|
| CN | 112196476 | A | 1/2021 |
| CN | 112780204 | A | 5/2021 |
| WO | 2022256454 | A1 | 12/2022 |

OTHER PUBLICATIONS

Impact Selector International, "Pump Down", www.impactselector.com, downloaded from https://uploads-ssl.webflow.com/5b83dd5bb40239357813897a/63dbf335f233ad959d6970c3_Datasheet%20Spitfire%20US%20223.pdf, Nov. 2002, one page.

(Continued)

*Primary Examiner* — Caroline N Butcher

(74) *Attorney, Agent, or Firm* — Trop, Pruner & Hu, P.C.

(57) ABSTRACT

A release tool that provides mechanical disconnection between, for example, a stuck tool string and the wireline cable in pumpdown perforating operations.

25 Claims, 15 Drawing Sheets

(56) References Cited

U.S. PATENT DOCUMENTS

| | | | | |
|---|---|---|---|---|
| 8,264,814 | B2 | 9/2012 | Love et al. | |
| 8,540,021 | B2 | 9/2013 | McCarter et al. | |
| 8,576,090 | B2 | 11/2013 | Lerche et al. | |
| 8,807,228 | B2 | 8/2014 | Martin et al. | |
| 8,887,817 | B2 | 11/2014 | Le Briere et al. | |
| 9,068,415 | B2 | 6/2015 | Fraser | |
| 9,598,940 | B2 | 3/2017 | Rodgers et al. | |
| 9,822,596 | B2 | 11/2017 | Clemens et al. | |
| 9,963,948 | B2 | 5/2018 | Tao et al. | |
| 10,094,190 | B2 | 10/2018 | Grattan et al. | |
| 10,240,420 | B2 | 3/2019 | Arnaly | |
| 10,538,984 | B2 | 1/2020 | Bell et al. | |
| 10,655,416 | B2 | 5/2020 | Massey et al. | |
| 10,669,799 | B2 | 6/2020 | Massey | |
| 10,794,122 | B2 | 10/2020 | Kitchen et al. | |
| 11,021,923 | B2 | 6/2021 | Mulhern et al. | |
| 11,047,178 | B2 | 6/2021 | Massey et al. | |
| 11,156,051 | B2 | 10/2021 | Jones | |
| 11,162,305 | B2 | 11/2021 | Massey et al. | |
| 11,306,547 | B2 | 4/2022 | Thomas | |
| 11,326,408 | B2 | 5/2022 | Clemens et al. | |
| 2005/0284635 | A1 | 12/2005 | Neves | |
| 2012/0186826 | A1* | 7/2012 | Le Briere ..... | E21B 17/06 166/242.6 |
| 2018/0363402 | A1 | 12/2018 | Hradecky | |
| 2022/0364421 | A1 | 11/2022 | Nguyen et al. | |
| 2023/0098383 | A1 | 3/2023 | Philpott et al. | |

OTHER PUBLICATIONS

Dyna Energetics, "Setting and Release Tools", www.dynaenergetics.com, downloaded from https://www.dynaenergetics.com/products/Unconventional-Systems/DynaStage-Auxillary-Tools, six pages.

Thru-Tubing Systems, "Series 1201—Selective Release Tool", www.thrutubingsystems.com, downloaded from https://web.archive.org/web/20221003035451/http://www.thrutubingsystems.com/intervention-products-and-services.php?product=/wireline-products/series-1201-selective-release-tool, two pages.

Integrity Wireline, "Ballistic Release Tool", www.integritywireline.com, downloaded from https://www.integritywireline.com/wireline-ballistic-release-tool-is-a-job-saver/, eleven pages.

GEODynamics, "Release", www.perf.com, downloaded from https://www.perf.com/release, three pages.

Core Laboratories, "Addressable Release Tool", www.corelab.com, downloaded from https://www.corelab.com/products/addressable-release-tool/, four pages.

Baker Hughes, "Addressable Downhole Release (ADR) Cased-Hole Tool Suite", www.bakerhughes.com, downloaded from https://www.bakerhughes.com/evaluation/wireline-mechanical-services/wireline-deployment-services/addressable-downhole-release-adr-casedhole-tool-suite, six pages.

Schlumberger, "DCR Digital Controlled Release Tool", www.slb.com, downloaded from https://web.archive.org/web/20231001211153/https://www.slb.com/products-and-services/innovating-in-oil-and-gas/well-intervention/slickline-and-wireline-intervention/live-digital-slickline-services/dcr-digital-controlled-release-tool, seven pages.

* cited by examiner

| PARTS LIST | | |
|---|---|---|
| ITEM | QTY | PART NUMBER |
| 1 | 1 | SHEARING RING |
| 2 | 1 | HYDROSTATIC PLUG 1-O |
| 3 | 1 | KEYWAY |
| 4 | 1 | DETO A105 |
| 5 | 1 | HOLDER |
| 6 | 1 | LOWER BODY |
| 7 | 1 | UPPER BODY |
| 8 | 1 | RELEASE COLLAR #2 |
| 9 | 1 | RETAINER 91666A450 |
| 10 | 1 | HYDROSTATIC PLUG 2-O V1 |
| 11 | 2 | CONNECTION CAN |

PARTS LIST

| ITEM | QTY | PART NUMBER |
|---|---|---|
| 1 | 1 | SHEARING RING |
| 2 | 1 | HYDROSTATIC PLUG 1-O |
| 3 | 1 | KEYWAY |
| 4 | 1 | DETO A105 |
| 5 | 1 | HOLDER |
| 6 | 1 | LOWER BODY |
| 7 | 1 | UPPER BODY |
| 8 | 1 | RELEASE COLLAR #2 |
| 9 | 1 | RETAINER 91685A450 |
| 10 | 1 | HYDROSTATIC PLUG 2-O V1 |
| 11 | 2 | CONNECTION CAN |

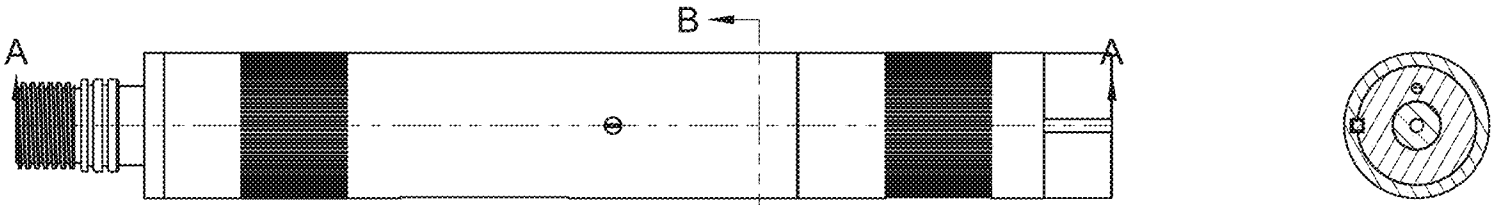
Figure 2A
SECTION B-B
Fig. 2C
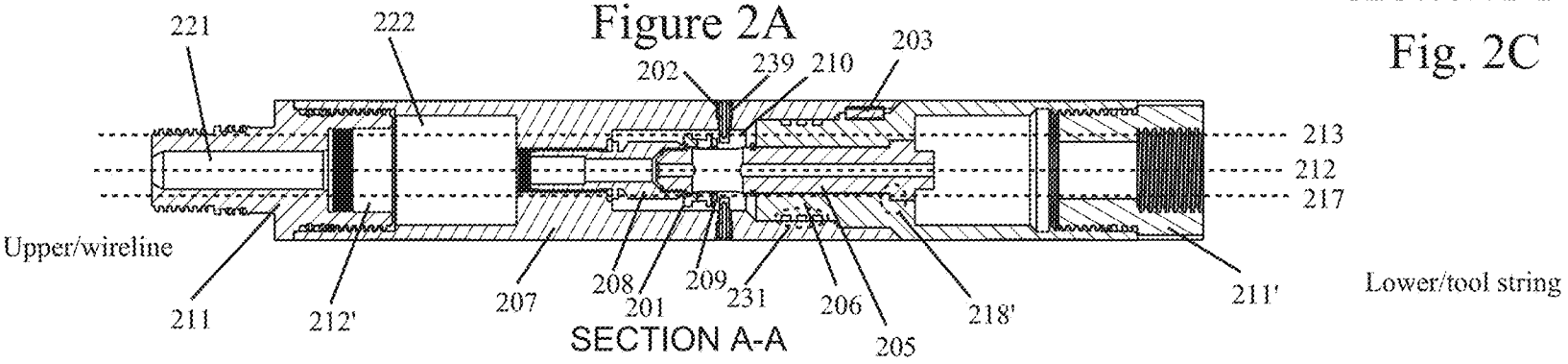
SECTION A-A
Fig. 2B

DETAIL B

DETAIL C

SECTION D-D

SECTION A-A

SECTION A-A

Cutout ISO View

Complete ISO View

SECTION D-D

SECTION B-B

DETAIL C

Fig. 5D
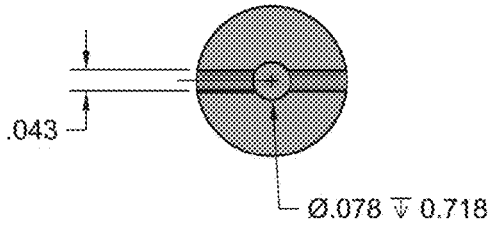
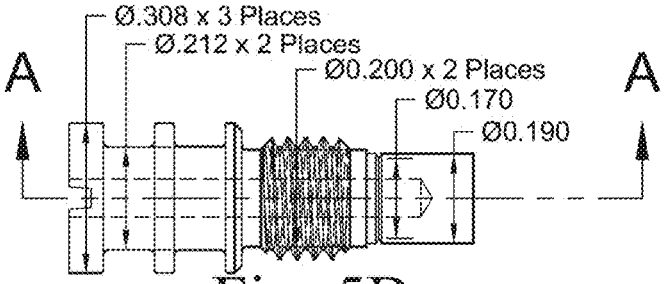
Fig. 5B
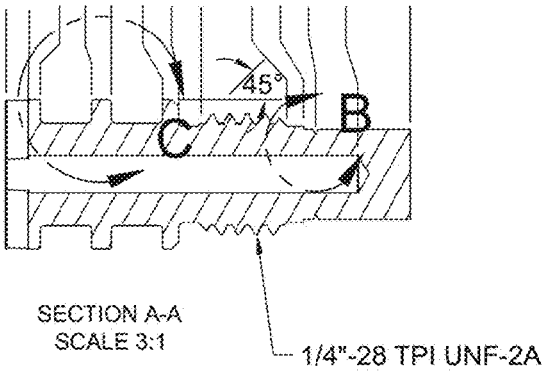
Fig. 5C
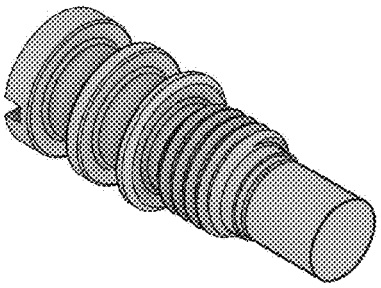
Fig. 5A

SECTION A-A

Fig. 7B
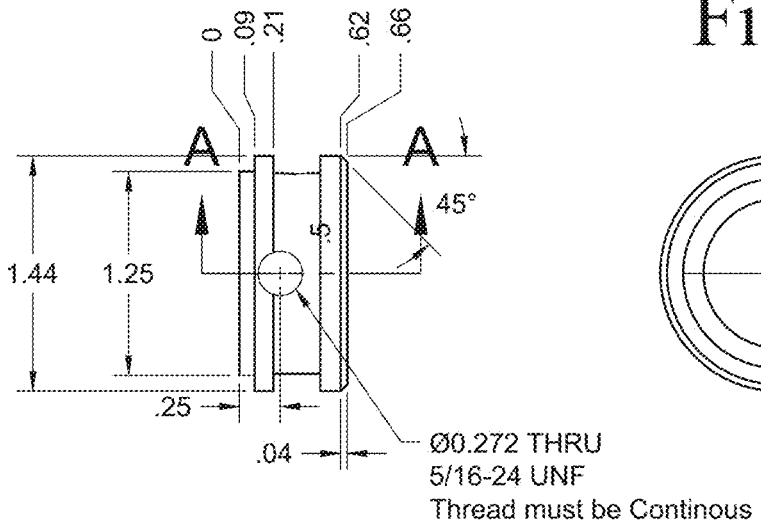
Fig. 7C
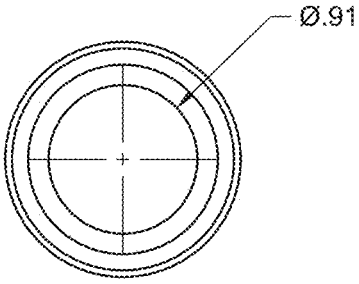
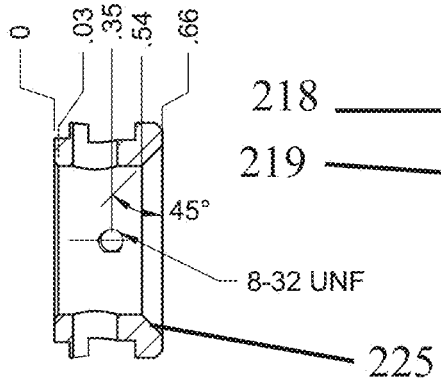
SECTION A-A
Fig. 7D
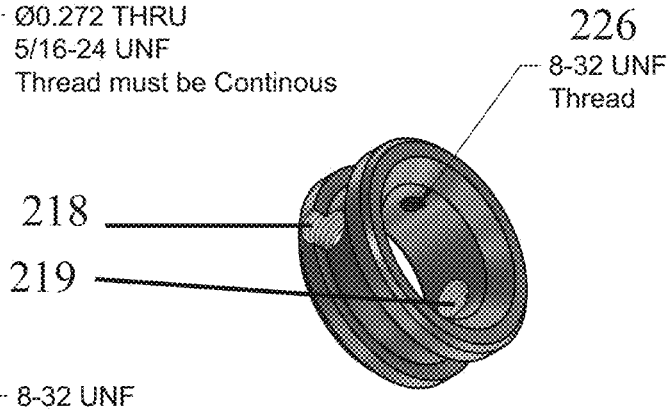
Fig. 7A Fig. 8B
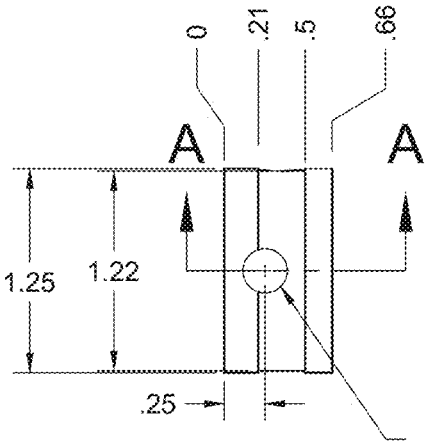
Fig. 8C
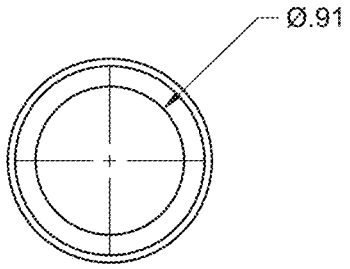
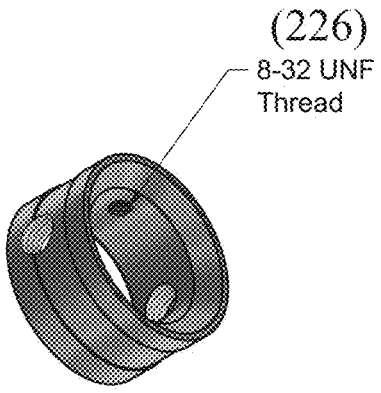
Fig. 8A
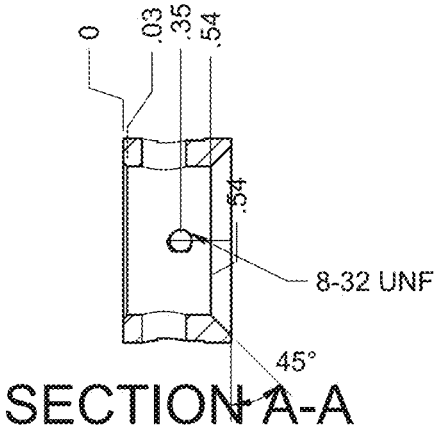
Fig. 8D

SECTION A-A

SECTION B-B

DETAIL C

DETAIL D

SECTION A-A

DETAIL B

DOWNHOLE SEPARATION SYSTEM

CROSS-REFERENCE TO RELATED APPLICATION

This application claims priority to U.S. Provisional Patent Application No. 63/504,318 filed on May 25, 2023 and entitled "Downhole Separation System", the content of which is hereby incorporated by reference.

TECHNICAL FIELD

Embodiments of the invention are in the field of energy technology and, in particular, downhole tools.

BACKGROUND

In many wireline operations, horizontal or high angle wells are drilled in order to maximize the borehole to formation area. Horizontal drilling offers many environmental and economic benefits, some of which include avoiding difficult and environmentally sensitive rock layers and surface sites, reducing the cost and surface impact by drilling one single well instead of multiple ones in one area, increasing the length of the pay zone, allowing better access to the oil and gas reserves that are spread across the rock formation, etc.

As technology advances for exploration tools, operators try to maximize their operations by drilling deeper and highly deviated wells. Such advances have impacted the way other completion operations are executed. Pumpdown perforating, which is utilized in many of the wells drilled today, is a method to convey composite plugs and perforating guns in horizontal wells by pumping fluids into the wellbore to force the gun string into the lateral section of the well. Pumpdown perforating consists of lowering a perforating gun (loaded with explosive shaped charges) into a well and detonating explosives by initiating an electric device (addressable switch) in the gun. The shaped charges inside the gun pierce the casing, cement, and formation, enabling a channel for chemicals and proppants to force the fractures open through hydraulic fracturing.

Tools, equipment, and explosives are commonly introduced into the wellbore via an electrical and mechanical tether called a wireline. A wireline refers to a multi-conductor or single-conductor electric cable that may be utilized for well completions, well intervention, and formation evaluation operations. The wireline cable may be wrapped around a drum mount system on the back of a cab chassis truck. The wireline is raised and lowered in the well by reeling in and out the wire hydraulically. The wireline cables utilized are typically 20,000-30,000 feet long to make sure the tools can travel safely to their end point. The wireline cable, by design, according to their manufacturer and material, has different limits such as pressure rating and tension rating and these values vary depending on the environment and temperature of the wellbore.

BRIEF DESCRIPTION OF THE DRAWINGS

Features and advantages of embodiments of the present invention will become apparent from the appended claims, the following detailed description of one or more example embodiments, and the corresponding figures. Where considered appropriate, reference labels have been repeated among the figures to indicate corresponding or analogous elements.

FIG. 2A includes a side view of an embodiment of a downhole separation tool. FIG. 2B and FIG. 2C include cross-sectional views of the embodiment of FIG. 2A.

FIGS. 5A, 5B, 5C, 5D include differing views of an embodiment of a plug.

FIGS. 7A, 7B, 7C, 7D include differing views of an embodiment of an intermediate conduit.

FIGS. 8A, 8B, 8C, 8D include differing views of an embodiment of an intermediate conduit.

DETAILED DESCRIPTION

Figure 1A:
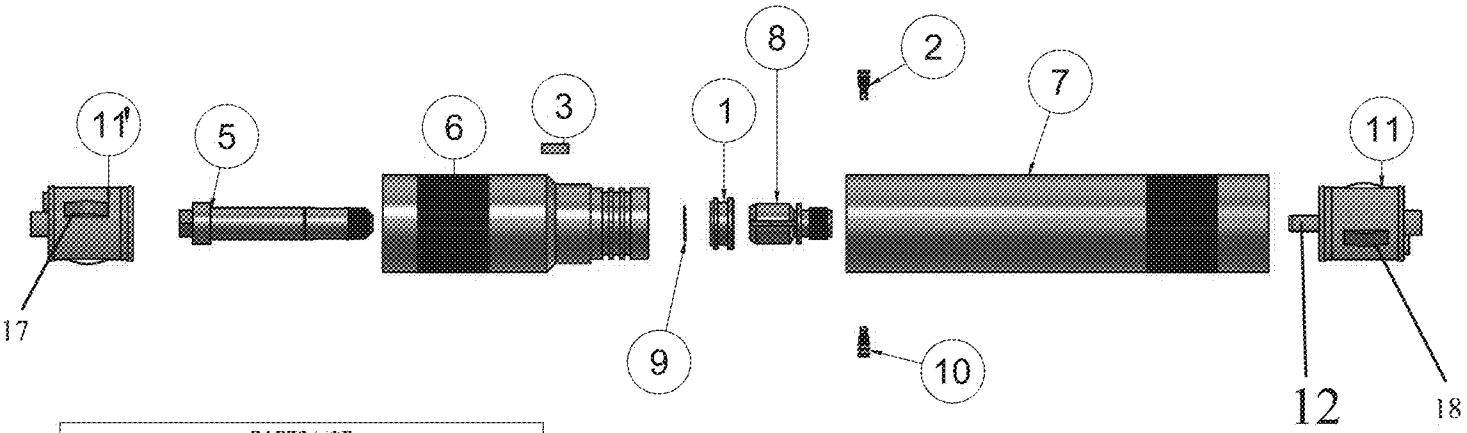
FIG. 1A includes an assembly drawing of an embodiment of a downhole separation tool.

Reference will now be made to the drawings wherein like structures may be provided with like suffix reference designations. In order to show the structures of various embodiments more clearly, the drawings included herein are diagrammatic representations of structures. Thus, the actual appearance of the fabricated structures, for example in a photo, may appear different while still incorporating the claimed structures of the illustrated embodiments (e.g., walls may not be exactly orthogonal to one another in actual fabricated devices). Moreover, the drawings may only show the structures useful to understand the illustrated embodiments. Additional structures known in the art may not have been included to maintain the clarity of the drawings. For example, not every layer of a device is necessarily shown. "An embodiment", "various embodiments" and the like indicate embodiment(s) so described may include particular features, structures, or characteristics, but not every embodiment necessarily includes the particular features, structures, or characteristics. Some embodiments may have some, all, or none of the features described for other embodiments. "First", "second", "third" and the like describe a common object and indicate different instances of like objects are being referred to. Such adjectives do not imply objects so described must be in a given sequence, either temporally, spatially, in ranking, or in any other manner. "Connected" may indicate elements are in direct physical or electrical contact with each other and "coupled" may indicate elements co-operate or interact with each other, but they may or may not be in direct physical or electrical contact. Phrases such as "comprising at least one of A or B" include situations with A, B, or A and B.

Applicant recognized that each wireline cable holds a safe pull value, which tells the user how much tension and force it can withstand before breaking. Often times during operations the tools might get "stuck". This happens due to unexpected debris on the tool string still present from previous hydraulic fracturing operations, the high deviation of the wells, small tolerances relative to the wireline tools, etc. When this happens a few options are available including, for example, pulling on the tools utilizing the wireline strength (determined by safe pull values) and pumping fluids to free the tools.

Applicant further recognized that when planning a job, the safe working load of the cable is considered to pick the right weak point for the job. A mechanical weak point is a piece of metal engineered to break at a rated tension. The weak point provides a weak link between the wireline cable and the tool string, and may be installed inside the cable head or anywhere in the downhole system where a separation may be desired. In order to break the weak point, a calculation is performed to determine how much pull is needed to be applied. Such a value must be within the safe working load of the cable. Because of the limiting factor it presents, a release tool is typically used for faster and more effective means of separation. In order to improve the way operations are performed, Applicant desired to have a full-strength head (no weak point) in order to have a more secure connection to the tools to prevent unintentional pull off and pump offs. At least one embodiment accomplishes this goal with a head release device.

Applicant recognized pulling on the tools becomes a difficult task depending on the location of the tools relative to the well, especially in horizontal wells, based on friction on tools induced by the curvature in the well. Applicant determined having a fast separation tool on the tool string is an effective way to "release" such tools both lowering the risk of the cable breaking and avoiding accidents on surface. In at least one embodiment, a fast separation tool is located below the weight bars and casing collar locator. The tool is activated electronically by an addressable switch, which receives a command from the surface and sends a signal to the detonator to fire. As the tool "fires" it separates the tool string from an upper portion of the wireline. An embodiment of the separation tool is "switch agnostic" and compatible with most addressable switches and detonators.

An objective of an embodiment of the release tool is to provide a mechanical disconnection between a stuck tool string and the wireline cable. To that end, an embodiment is operated with a detonator. In the event that such detonator is activated, the tool is designed to equalize pressure and disconnect mechanically from the lower section of the tool, allowing the retrieval of the cable and further fishing operations. The tool is composed of variable parts which work together effectively.

Figure 1B:
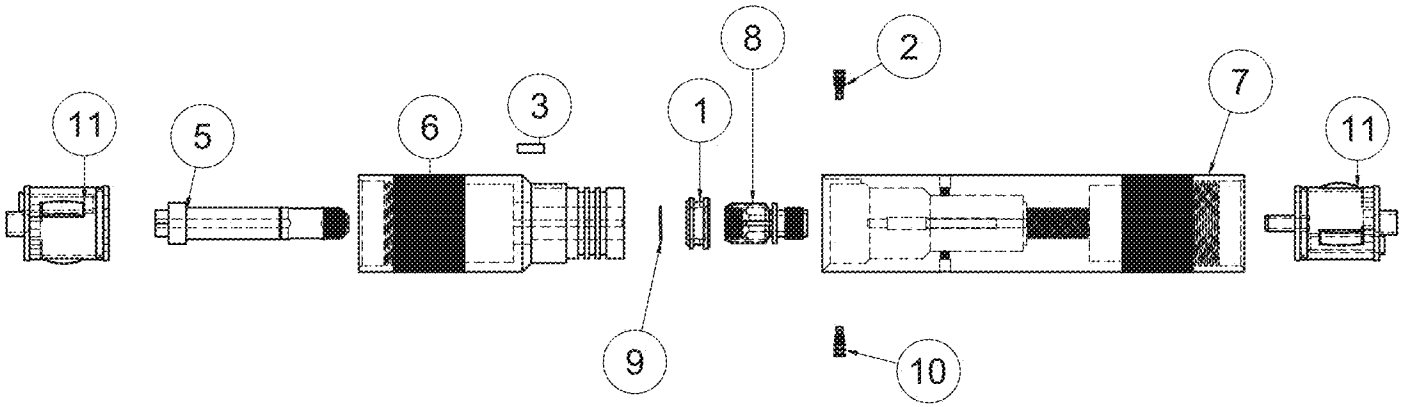
FIG. 1B includes the view of FIG. 1A with phantom lines.
Figure 3D:
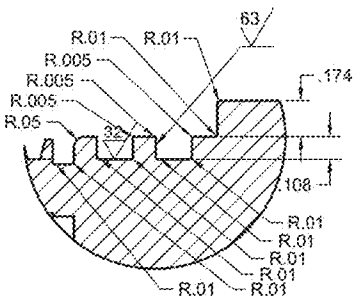
FIGS. 3A, 3B, 3C, 3D, 3E include differing views of an embodiment of an upper cap.
Figure 3E:
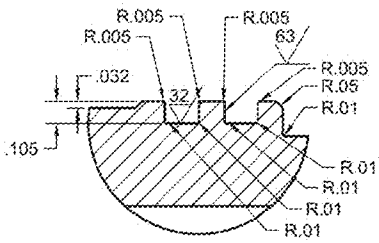
Figure 3C:
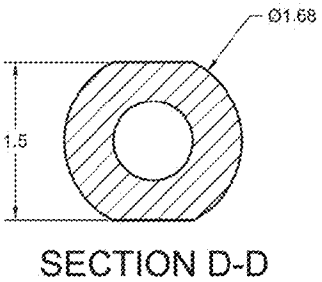
Figure 3A:
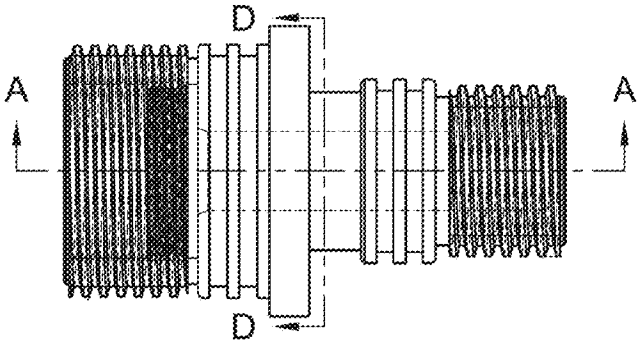
Figure 3B:
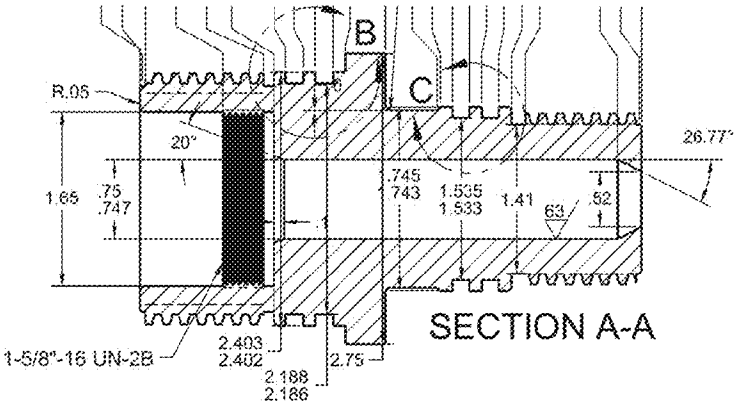

In the embodiment of FIGS. 1A-1B, the upper body 7 is the largest part on the assembly and structurally holds most of the components. It has keyway 3 for alignment, an internal channel for the through wire, equalization plug threads for plugs 2 and 10, sealing surfaces to withstand pressure, and threads for the release of collar 8.

In an embodiment, the lower body 6 or fishing neck stays connected to the gun string after release. It is hollow to receive slide stud assembly 5, holds a through wire channel, holds sealing surface O-rings, and holds keyway 3.

The slide stud assembly 5 is installed inside the lower body. It contains shear ring 1, set screws, retainer ring 9, and a ¾" hex drive nut.

Equalization plug 2 is installed into the upper body. In an embodiment, the tool contains two of these equalization plugs (elements 2, 10). In an embodiment, the plugs are sheared clean once the detonator is fired. As a result of shearing the plugs, pressure is equalized inside the tool body.

The release collar 8 releases the joint between upper and lower bodies 7, 6. It flares out with the explosive blast.

Upper connection 11 provides housing for the addressable switch, holds detonator 12 in place, includes a pin to connect with a crossover, and provides contact to ground with all 3 centralizers.

The lower connection 11' can house the through wire excess length and includes a pin to connect with the next tool. The upper cap 11 uses the detonator holder cap and the lower cap does not.

Upper crossover 11 provides connection into the casing collar locator (CCL). The lower crossover provides a connection into the gun string and does not use an internal insulator. The gun string top sub connects directly into the can pin of lower crossover 11'.

FIGS. 1A-1B and 2A-2B depict embodiments of a release tool that provide mechanical disconnection between, for example, a stuck tool string and the wireline cable in pumpdown perforating operations. One of the problems solved by the embodiments is the utilization of a full-strength head (i.e., head has no weak point) in order to have a more secure connection to the tools and thereby prevent unintentional pull offs and pump offs. In everyday operations, mechanical weak points are utilized to create a weak link between the wireline cable and the tool-string. By having a release device, the weak point is no longer needed as there is no need to "break" the cable in the event of a stuck tool situation. The embodiments have several advantages including: (1) safer and more reliable pump down operations, (2) fewer operational mistakes, (3) prevention of pump-offs and pull-offs, (4) reducing the risk of the wireline breaking when tools get stuck downhole in the wellbore, and (5) facilitating ease of assembly. At least some of these advantages are due, at least in part, to: (1) release mechanism 5, 205 (which couples the upper and lower sections 7 (or 207), 6 (or 206) to one another) including an internal rod (rather than a fixed body part), (2) the upper and lower sections being constrained in rotation with a keyway 3 (or 203), and (3) detonator 12 being installed on a removable piece 11 (rather than fixed to the tool with fasteners).

For example, as seen in FIG. 1B, some embodiments that utilize rod 5 may require as few as two threadings to assemble the system (e.g., coupling elements 7 and 8 together and coupling elements 5 and 8 together). Further, the keyway ensures torque applied to element 7 will be translated to a torque on element 6. This may help with trying to free a tool string that is stuck in place. Finally, having the detonator in a removable piece that may be resistively coupled (e.g., via resilient member(s)) to element 7 may ease assembly as compared to having the detonator deep within conduit 6 or 7.

Figure 12:
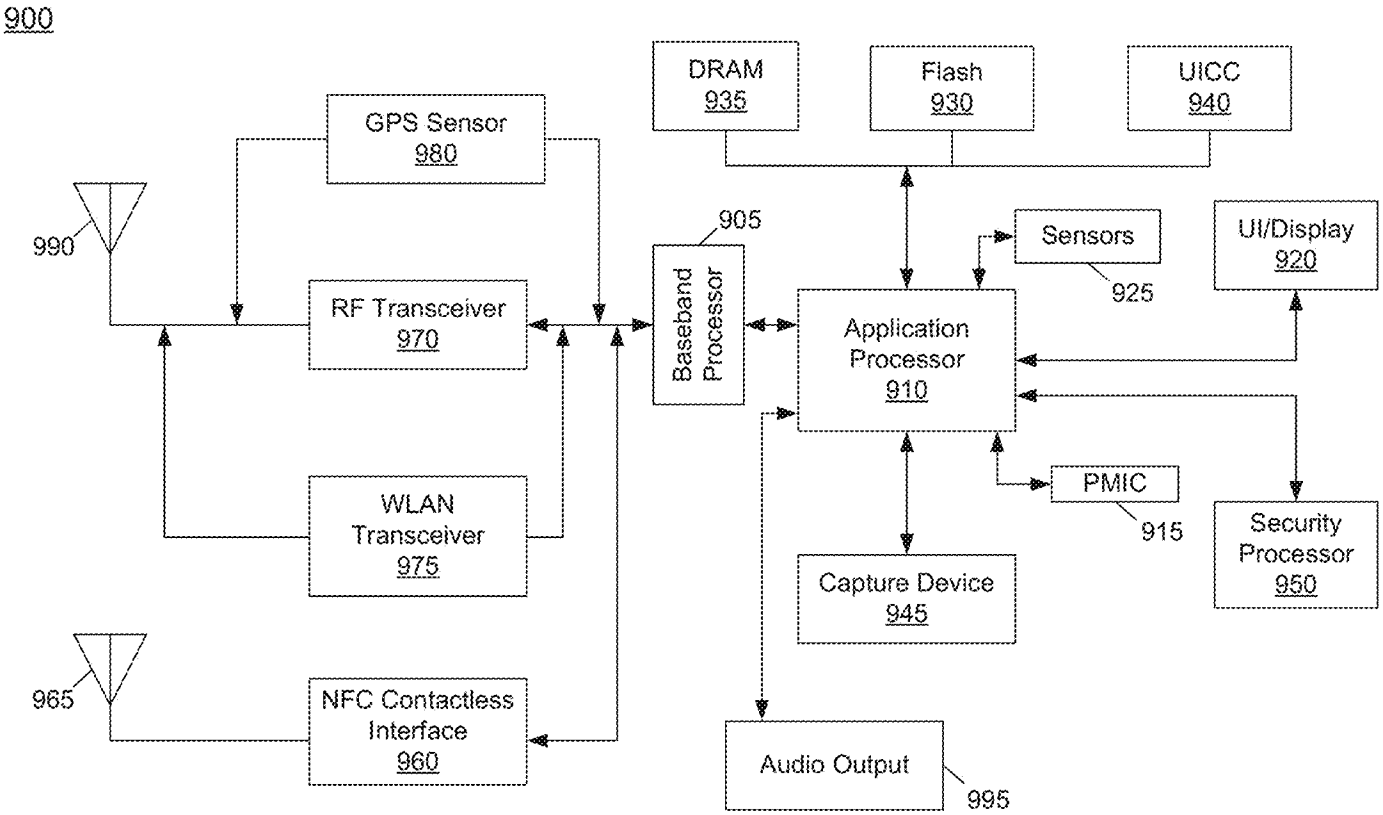
FIGS. 12, 13, 14 include systems to implement embodiments described herein.
Figure 13:
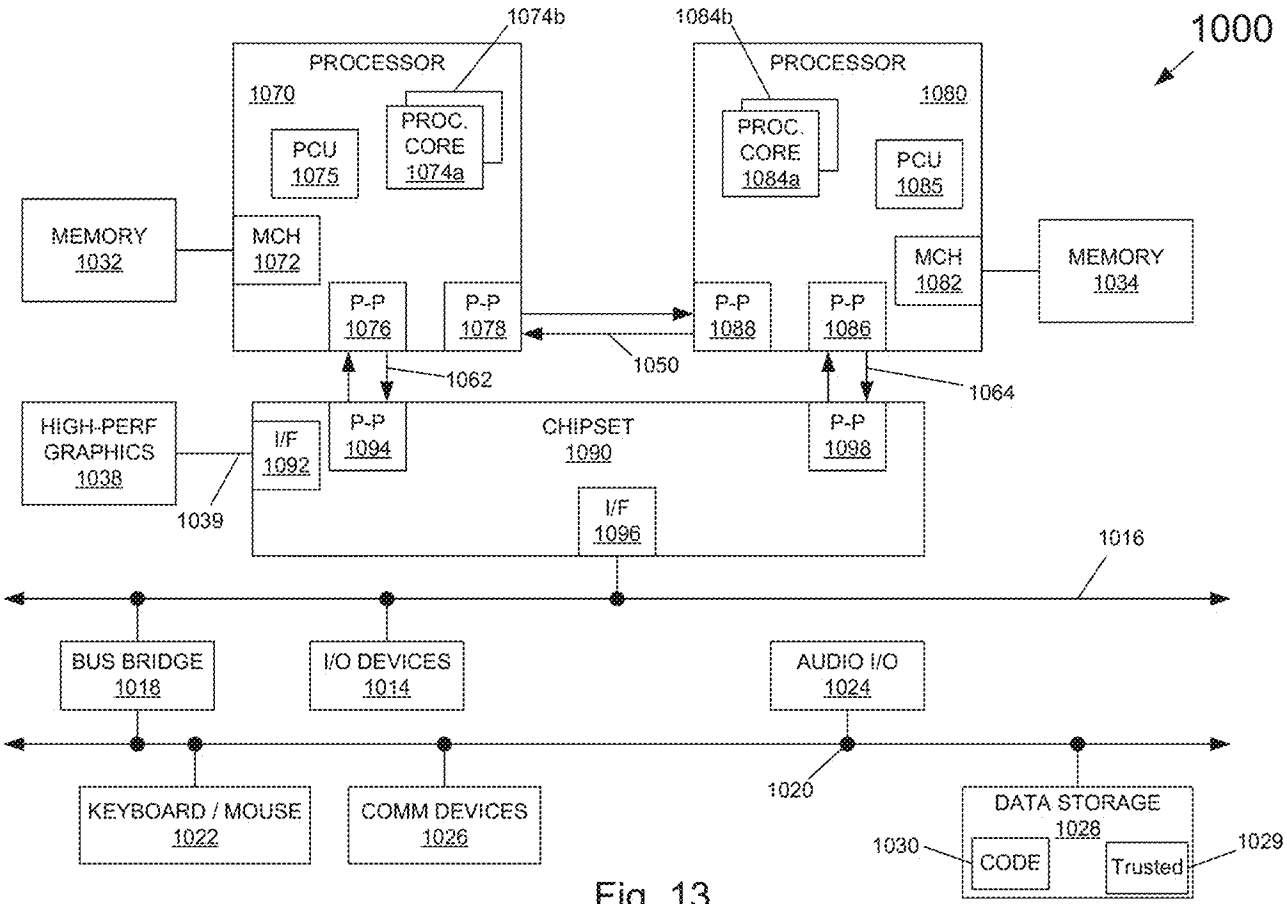
Figure 14:
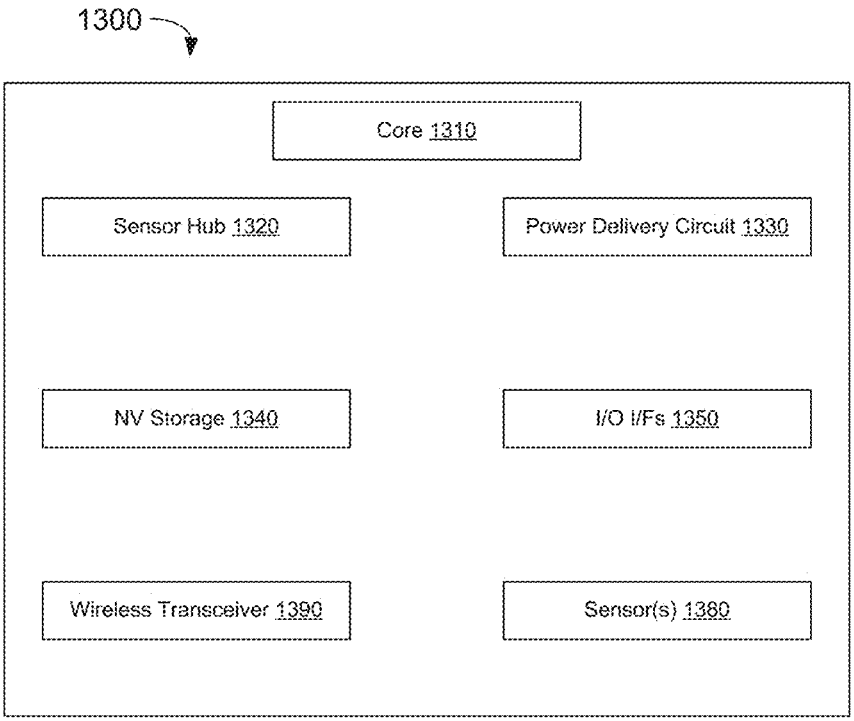

FIGS. 12-14 may be used to, for example, facilitate communications to the release tool (e.g., to detonate a charge to facilitate separation of upper and lower conduits of the tool), or through the release tool between elements above and below the release tool.

FIG. 12 includes a block diagram of an example system with which embodiments can be used. As seen, system 900 may be a smartphone or other wireless communicator or any other Internet of Things (IoT) device. A baseband processor 905 is configured to perform various signal processing with regard to communication signals to be transmitted from or received by the system. In turn, baseband processor 905 is coupled to an application processor 910, which may be a main CPU of the system to execute an OS and other system software, in addition to user applications such as many well-known social media and multimedia apps. Application processor 910 may further be configured to perform a variety of other computing operations for the device.

In turn, application processor 910 can couple to a user interface/display 920 (e.g., touch screen display). In addition, application processor 910 may couple to a memory system including a non-volatile memory, namely a flash memory 930 and a system memory, namely a DRAM 935. As further seen, application processor 910 also couples to a capture device 945 such as one or more image capture devices that can record video and/or still images.

A universal integrated circuit card (UICC) 940 comprises a subscriber identity module, which in some embodiments includes a secure storage to store secure user information. System 900 may further include a security processor 950 (e.g., Trusted Platform Module (TPM)) that may couple to application processor 910. A plurality of sensors 925, including one or more multi-axis accelerometers may couple to application processor 910 to enable input of a variety of sensed information such as motion and other environmental information. In addition, one or more authentication devices may be used to receive, for example, user biometric input for use in authentication operations.

As further illustrated, a near field communication (NFC) contactless interface 960 is provided that communicates in an NFC near field via an NFC antenna 965. While separate antennae are shown, understand that in some implementations one antenna or a different set of antennae may be provided to enable various wireless functionalities.

A power management integrated circuit (PMIC) 915 couples to application processor 910 to perform platform level power management. To this end, PMIC 915 may issue power management requests to application processor 910 to enter certain low power states as desired. Furthermore, based on platform constraints, PMIC 915 may also control the power level of other components of system 900.

To enable communications to be transmitted and received such as in one or more internet of things (IoT) networks, various circuits may be coupled between baseband processor 905 and antenna 990. Specifically, a radio frequency (RF) transceiver 970 and a wireless local area network (WLAN) transceiver 975 may be present. In general, RF transceiver 970 may be used to receive and transmit wireless data and calls according to a given wireless communication protocol such as 5G wireless communication protocol such as in accordance with a code division multiple access (CDMA), global system for mobile communication (GSM), long term evolution (LTE) or other protocol. In addition, a GPS sensor 980 may be present, with location information being provided to security processor 950. Other wireless communications such as receipt or transmission of radio signals (e.g., AM/FM) and other signals may also be provided. In addition, via WLAN transceiver 975, local wireless communications, such as according to a Bluetooth™ or IEEE 802.11 standard can also be realized.

FIG. 13 shows a block diagram of a system in accordance with another embodiment of the present invention. Multiprocessor system 1000 is a point-to-point interconnect system such as a server system, and includes a first processor 1070 and a second processor 1080 coupled via a point-to-point interconnect 1050. Each of processors 1070 and 1080 may be multicore processors such as SoCs, including first and second processor cores (i.e., processor cores 1074*a* and 1074*b* and processor cores 1084*a* and 1084*b*), although potentially many more cores may be present in the processors. In addition, processors 1070 and 1080 each may include power controller unit 1075 and 1085. In addition, processors 1070 and 1080 each may include a secure engine to perform security operations such as attestations, IoT network onboarding or so forth.

First processor 1070 further includes a memory controller hub (MCH) 1072 and point-to-point (P-P) interfaces 1076 and 1078. Similarly, second processor 1080 includes a MCH 1082 and P-P interfaces 1086 and 1088. MCH's 1072 and 1082 couple the processors to respective memories, namely a memory 1032 and a memory 1034, which may be portions of main memory (e.g., a DRAM) locally attached to the respective processors. First processor 1070 and second processor 1080 may be coupled to a chipset 1090 via P-P interconnects 1062 and 1064, respectively. Chipset 1090 includes P-P interfaces 1094 and 1098.

Furthermore, chipset 1090 includes an interface 1092 to couple chipset 1090 with a high-performance graphics engine 1038, by a P-P interconnect 1039. In turn, chipset 1090 may be coupled to a first bus 1016 via an interface 1096. Various input/output (I/O) devices 1014 may be coupled to first bus 1016, along with a bus bridge 1018 which couples first bus 1016 to a second bus 1020. Various devices may be coupled to second bus 1020 including, for example, a keyboard/mouse 1022, communication devices 1026 and a data storage unit 1028 such as a non-volatile storage or other mass storage device. As seen, data storage unit 1028 may include code 1030, in one embodiment. As further seen, data storage unit 1028 also includes a trusted storage 1029 to store sensitive information to be protected. Further, an audio I/O 1024 may be coupled to second bus 1020.

FIG. 14 depicts an IoT environment that may include wearable devices or other small form factor IoT devices. In one particular implementation, wearable module 1300 may be an Intel® Curie™ module that includes multiple components adapted within a single small module that can be implemented as all or part of a wearable device. As seen, module 1300 includes a core 1310 (of course in other embodiments more than one core may be present). Such a core may be a relatively low complexity in-order core, such as based on an Intel Architecture® Quark™ design. In some embodiments, core 1310 may implement a Trusted Execution Environment (TEE). Core 1310 couples to various components including a sensor hub 1320, which may be configured to interact with a plurality of sensors 1380, such as one or more biometric, motion, environmental or other sensors. A power delivery circuit 1330 is present, along with a non-volatile storage 1340. In an embodiment, this circuit may include a rechargeable battery and a recharging circuit, which may in one embodiment receive charging power wirelessly. One or more input/output (IO) interfaces 1350, such as one or more interfaces compatible with one or more of USB/SPI/I2C/GPIO protocols, may be present. In addition, a wireless transceiver 1390, which may be a Bluetooth™ low energy or other short-range wireless transceiver is present to enable wireless communications as described herein. In different implementations a wearable module can take many other forms. Wearable and/or IoT devices have, in comparison with a typical general-purpose CPU or a GPU, a small form factor, low power requirements, limited instruction sets, relatively slow computation throughput, or any of the above.

Embodiments may be used in many different types of systems. For example, in one embodiment a communication device can be arranged to perform the various methods and techniques described herein. Of course, the scope of the present invention is not limited to a communication device, and instead other embodiments can be directed to other types of apparatus for processing instructions, or one or more machine readable media including instructions that in response to being executed on a computing device, cause the device to carry out one or more of the methods and techniques described herein.

Program instructions may be used to cause a general-purpose or special-purpose processing system that is programmed with the instructions to perform the operations described herein. Alternatively, the operations may be performed by specific hardware components that contain hard-wired logic for performing the operations, or by any combination of programmed computer components and custom hardware components. The methods described herein may be provided as (a) a computer program product that may include one or more machine readable media having stored thereon instructions that may be used to program a processing system or other electronic device to perform the methods or (b) at least one storage medium having instructions stored thereon for causing a system to perform the methods. The term "machine readable medium" or "storage medium" used herein shall include any medium that is capable of storing or encoding a sequence of instructions (transitory media, including signals, or non-transitory media) for execution by the machine and that cause the machine to perform any one of the methods described herein. The term "machine readable medium" or "storage medium" shall accordingly include, but not be limited to, memories such as solid-state memories, optical and magnetic disks, read-only memory (ROM), programmable ROM (PROM), erasable PROM (EPROM), electrically EPROM (EEPROM), a disk drive, a floppy disk, a compact disk ROM (CD-ROM), a digital versatile disk (DVD), flash memory, a magneto-optical disk, as well as more exotic mediums such as machine-accessible biological state preserving or signal preserving storage. A medium may include any mechanism for storing, transmitting, or receiving information in a form readable by a machine, and the medium may include a medium through which the program code may pass, such as antennas, optical fibers, communications interfaces, and the like. Program code may be transmitted in the form of packets, serial data, parallel data, and the like, and may be used in a compressed or encrypted format. Furthermore, it is common in the art to speak of software, in one form or another (e.g., program, procedure, process, application, module, logic, and so on) as taking an action or causing a result. Such expressions are merely a shorthand way of stating that the execution of the software by a processing system causes the processor to perform an action or produce a result.

A module as used herein refers to any hardware, software, firmware, or a combination thereof. Often module boundaries that are illustrated as separate commonly vary and potentially overlap. For example, a first and a second module may share hardware, software, firmware, or a combination thereof, while potentially retaining some independent hardware, software, or firmware. In one embodiment, use of the term logic includes hardware, such as transistors, registers, or other hardware, such as programmable logic devices. However, in another embodiment, logic also includes software or code integrated with hardware, such as firmware or micro-code.

Various examples are now addressed. Examples within a "set" refer to other examples within the same set. For instance, Example 2 in the first example set referring to Example 1 is referring to Example 1 of the first example set.

First Example Set

Example 1. As seen in FIGS. 2A-2B, a system comprises upper (207) and lower (206) conduits slidingly coupled to one another without threads directly connecting the upper and lower conduits to one another. The system includes upper (211) and lower (211') caps, the upper cap being coupled to the upper conduit between the upper conduit and a wireline portion and the lower cap being coupled to the lower conduit between the lower conduit and a tool string portion. The system includes upper (208) and lower (205) rods, wherein: (a) the upper rod is coupled, via threads, to the upper conduit and the lower rod, and (b) the lower rod is coupled to the lower conduit without threads directly connecting the lower rod to the lower conduit. Intermediate conduit (201) surrounds the lower rod and is slidingly coupled to the lower rod without threads directly connecting the intermediate conduit to the lower rod. Plug (202) is included in passage (239), the passage coupling an exterior surface of the upper conduit to void (210) included in the upper conduit. Central axis 212 traverses the upper and lower conduits, the upper and lower caps, and the upper and lower rods. Additional axis (213), which is parallel to the central axis, intersects the intermediate collar and a portion of the plug, the portion of the plug directly interfacing the void included in the upper conduit.

As used herein, "upper" and "lower" are relative terms meant to ease understanding of the Detailed Description. As such, a typical orientation used to visualize features of embodiments includes a situation with tool vertically oriented in the wellbore with a wireline above it (closer to the earth's surface) and a tool string below it (further from the earth surface). However, in other situations the wireline/separation tool/tool string may be located in, for example, a horizontal portion of the well. In such a case, element 211 is still "above" or "upper" with regard to element 211' (despite elements 211, 211' being the same distance below the earth's surface.

As used herein, a "rod" may be hollow or solid. As used herein, a "conduit" does not necessarily have to form a contiguous uninterrupted ring in a cross-section of the conduit.

Example 2. The system of Example 1 comprising an explosive charge and a detonator assembly, wherein the detonator assembly is at least partially included in void (212') included in the upper cap.

Figure 10E:
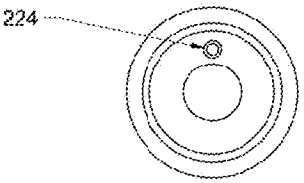
FIGS. 10A, 10B, 10C, 10D, 10E, 10F, 10G, 10H, 10I include differing views of an embodiment of a lower conduit.
Figure 10B:
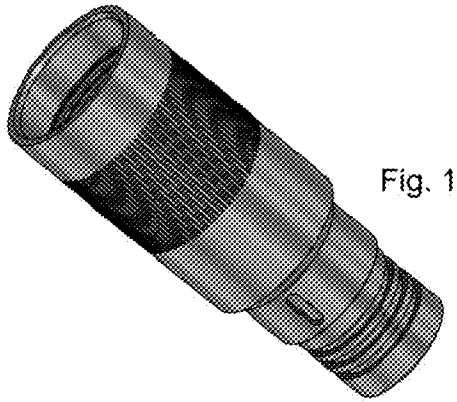
Figure 10A:
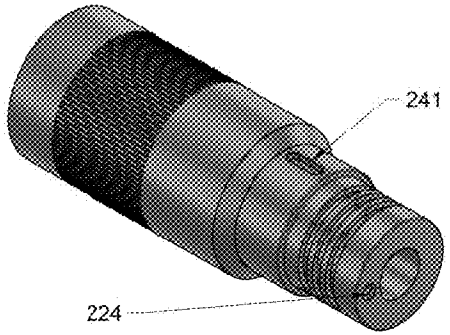
Figure 10C:
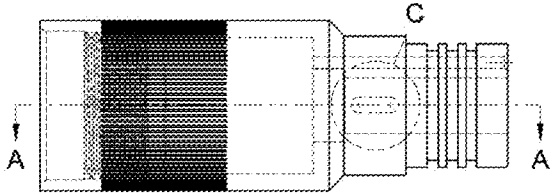
Figure 10F:
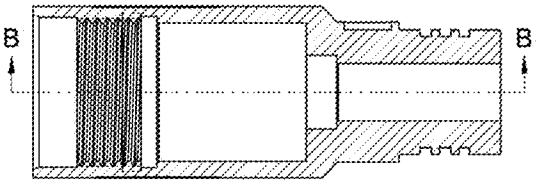
Figure 10G:
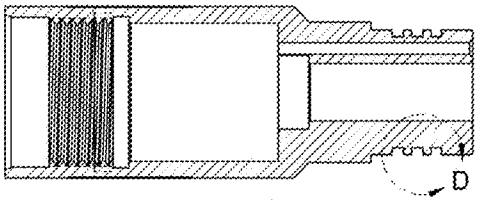
Figure 10D:
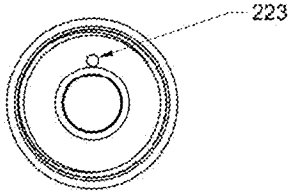
Figure 10H:
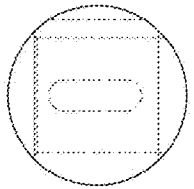
Figure 10I:
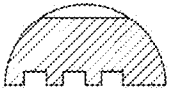
Figure 11A:
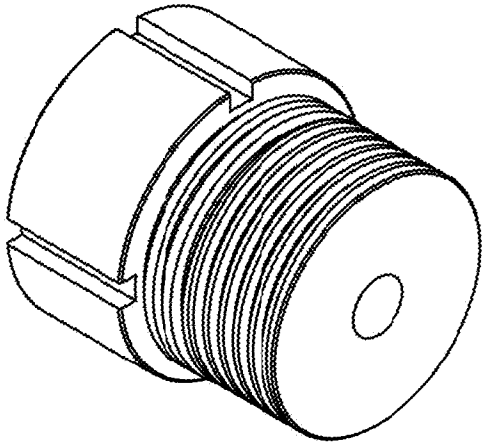
FIGS. 11A, 11B, 11C, 11D, 11E include differing views of an embodiment of a lower cap.
Figure 11C:
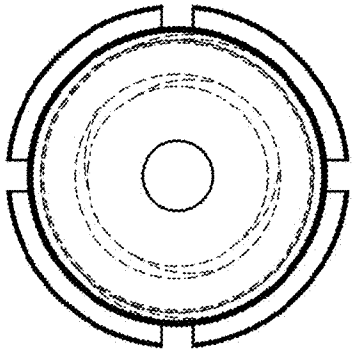
Figure 11B:
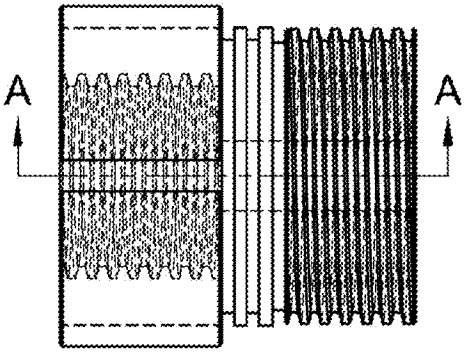
Figure 11D:
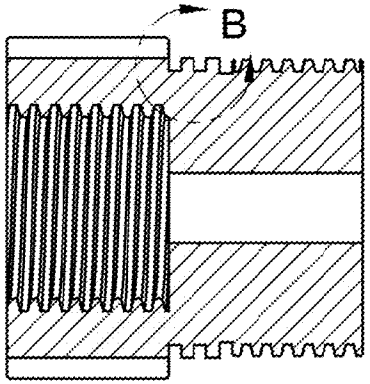
Figure 11E:
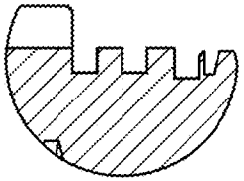

This assembly is not necessarily shown in element 211 of FIG. 2B to allow focus to remain on other parts of the tool. However, the assembly (or portions thereof) may be included in voids 212', 221, and/or 222. With regard to voids and electronics in general, the entire tool includes a series of voids/passages to allow conveyance of communications across the tool and between upper and lower portions of the downhole assembly, which may include wirelines, tool strings, and the like. As can be seen in FIG. 2B, a path of voids for wires, nodes, and general means for communications of signals traverses the entire length of the tool. However, depending on where cross-sections are taken for figures included herein, some such paths for communications may not be visible. In other words, it may be implicit to a person of ordinary skill in the art that wiring paths, traces, and the like may exist to convey communications (e.g., log data, firing commands, etc.) across the tool. Examples of communication paths seen in some orientations, but not in others, includes paths 223, 224 of FIGS. 10D, 10E.

Example 3. The system according to any of Examples 1-2, wherein: the upper and lower conduits are slidingly coupled to one another in a direction parallel to the central axis. The upper and lower conduits are keyed to one another via a key (203). The key obstructs rotation, about the central axis, of the upper conduit with respect to the lower conduit.

Figure 4E:
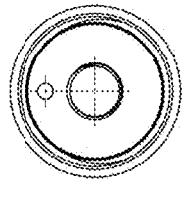
FIGS. 4A, 4B, 4C, 4D, 4E, 4F, 4G, 4H, 4I include differing views of an embodiment of an upper conduit.
Figure 4C:
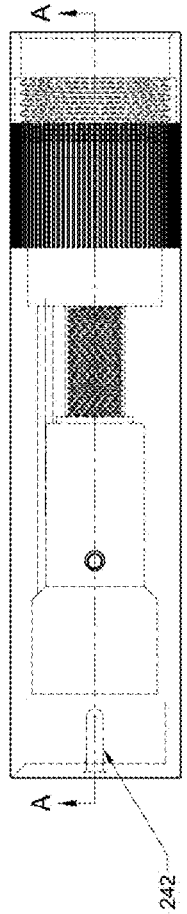
Figure 4D:
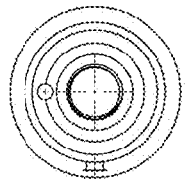
Figure 4F:
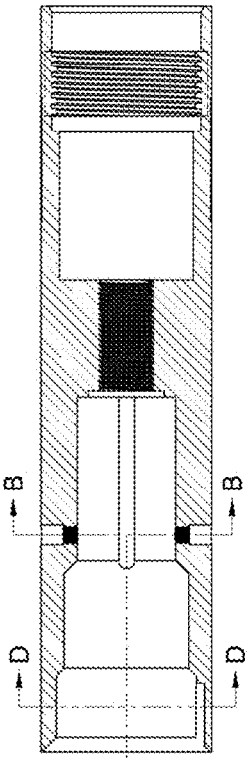
Figure 4B:
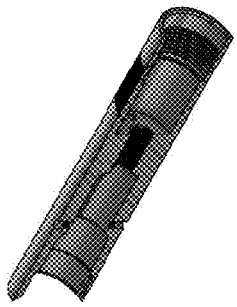
Figure 4A:
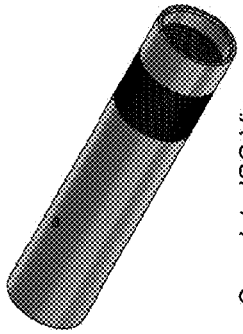
Figure 4H:
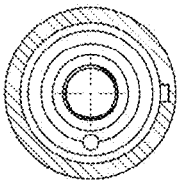
Figure 4G:
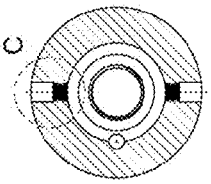
Figure 4I:
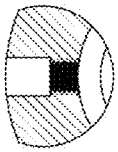

Key 203 may couple to slots 241, 242 (FIG. 4C, 10A), to ensure any torque applied to the upper conduit will be transferred to the lower conduit (because the two conduits do not rotate with respect to one another) without also loosening the coupling between the upper and lower conduits (which may occur if the upper and lower conduits were threaded to one another without the use of, for example, lower rod 205). Further, this keying helps avoid the need for precise alignment between the upper and lower conduits. For example, different communication nodes may be included with the separation device to provide electrical continuity so communications may pass through the separation device between the wireline and the tool string. These nodes may need to be precisely aligned in some situations where the upper and lower conduits are threaded together. However, this need for precision is avoided with the keying method described herein.

Figure 6B:
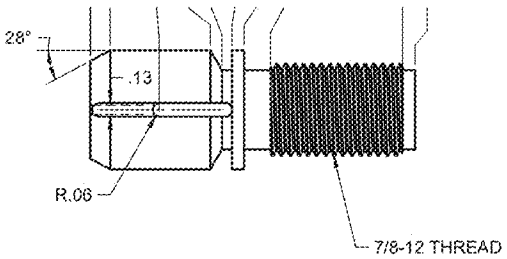
FIGS. 6A, 6B, 6C, 6D, 6E include differing views of an embodiment of an upper rod.
Figure 6D:
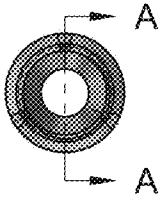
Figure 6E:
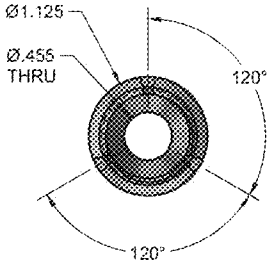
Figure 6C:
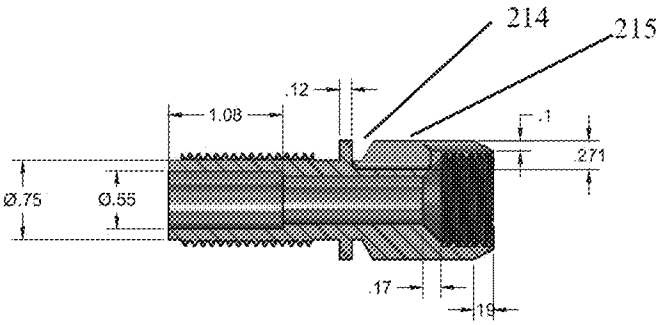

Example 4. The system according to any of Examples 1-3, wherein: the upper rod includes a threaded portion, a narrowed outer diameter (214) portion, and a widened outer diameter (215) portion. See, e.g., FIG. 6C. The narrowed outer diameter portion is between the threaded portion and the widened outer diameter portion.

Example 5. The system of Examples 2 and 4, wherein the narrowed outer diameter portion is configured to fracture in response to detonation of the explosive charge.

For example, in an embodiment a detonation occurring in cap 211 may provide a force towards the tool string. The force may be such that the non-threaded portion of the upper rod is forced down toward the tool string and the area just after the threaded portion of the upper rod may experience such force that a fracture and overall failure occurs at area 214. Area 215 may slide towards the tool string thereby pushing the lower rod and/or the intermediate rod towards the tool string. As the intermediate conduit 201 moves, the intermediate conduit will contact one or more plugs 202 thereby severing the plugs. In so doing, outside pressure may force fluid into void 210 via path 239, thereby exerting a force on the lower conduit to separate the lower conduit from the upper conduit. Afterwards, fishing can occur to attempt recovery of the lower conduit. Such fishing techniques may include placing a fishing tool over the narrowed diameter of the lower conduit near O-rings 231.

While some O-rings and fluid seals are explicitly labeled, such as seals 231, others may be visible and, while not labeled, are still known to one of ordinary skill in the art when viewing the figures. For example, O-rings may be included below the threads on element 211'.

Without severing the plugs, well pressure outside the tool may force the lower portion of the tool upwards against the upper portion of the tool even after the upper rod has been fractured due to the detonation. This may cause the upper and lower conduits to remain coupled. However, shearing the plugs allows well pressure to enter void 210 and thereby equalize pressure between the void and outside well pressure. This then lessens the upward force on the tool from well pressure.

The intermediate conduit may include chamfer edge (225) (FIG. 7D) to better mate with the upper rod when the upper rod is forced downwards due to the detonation. The chamfer edges distribute bending forces through the tool and avoid strain points. Further, embodiments are addressed at a high level to promote clarity, and not all features are addressed. For example, a set screw (see path 226) (FIG. 8A) may be used to hold the intermediate conduit in place with respect to the lower rod (see path 227 to receive the screw) (FIG. 9A).

Embodiments may include any number of plugs, such as 1, 2, 3 or more to promote pressure equalization as described above. The plugs may be threaded into the upper conduit to ensure they remain in place.

Retainer ring 209 (FIG. 2B) may be used to help separate the intermediate ring from the plug(s). The ring provides mass and transfer of energy to sever the equalization plugs once the detonator is fired. The detonation itself may not sever the plugs so the ring travels "down" with enough accumulated energy to cut the equalization rings upon impact.

Figure 6A:
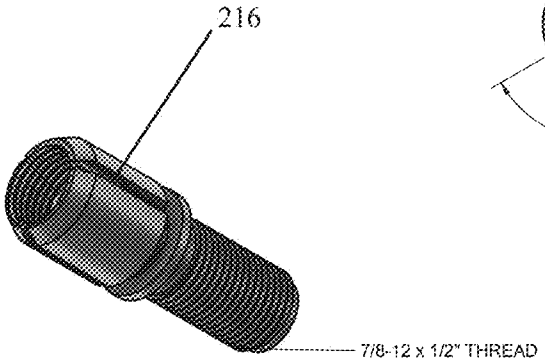

Example 6. The system of Example 4, wherein the upper rod includes at least one slot (216) (FIG. 6A) included in a wall that forms the widened outer diameter portion.

Example 7. The system of Example 6, wherein the slot includes a slot long axis that is parallel to the central axis.

Example 8. The system of Example 7, wherein the widened outer diameter portion is configured to spread radially away from the central axis in response to detonation of the explosive charge.

Example 9. The system according to any of Examples 1 to 8 comprising an upper resilient member (18) and a lower resilient member (17), wherein the upper resilient member retains at least a portion of the upper cap within the upper conduit and the lower resilient member retains at least a portion of the lower cap within the lower conduit.

For example, see FIG. 1A. Resilient members (e.g., springs) help, for example, quickly remove element 11 to disarm the tool. However, other means of coupling caps to system exist. For example, in FIG. 2A the upper cap couples to the upper conduit via threads and the lower cap couples to the lower conduit via threads.

Example 10. The system according to any of Examples 1 to 9, wherein: the lower rod includes a lower rod shoulder that interfaces a lower conduit shoulder of the lower conduit. Axis (217) intersects the lower rod shoulder and the lower conduit shoulder. Area 218' highlights the lower rod shoulder and the lower conduit shoulder. See, e.g., FIG. 2B.

As used herein, "threadingly coupled" means two elements threaded together. As used herein, "slidingly coupled" may mean two elements may slide (or have the ability to slide) with respect to each other along linear or rotational paths.

Example 11. The system according to any of Examples 1 to 10, wherein at least a portion of the intermediate conduit is between the plug and at least a portion of the upper rod.

Example 12. The system according to any of Examples 1 to 11, wherein the intermediate conduit includes first and second apertures (218, 219) that each couple an outer surface of the intermediate conduit to an inner surface of the intermediate conduit. See, e.g., FIG. 7A.

Example 13. The system of Example 12 wherein the bottom rod includes a third aperture (220) that couples an outer surface of the lower rod to an inner surface of the lower rod.

Figure 9B:
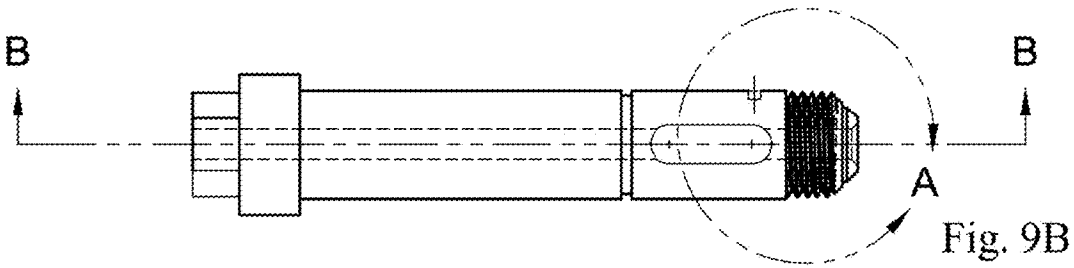
FIGS. 9A, 9B, 9C, 9D, 9E include differing views of an embodiment of a lower rod.
Figure 9E:
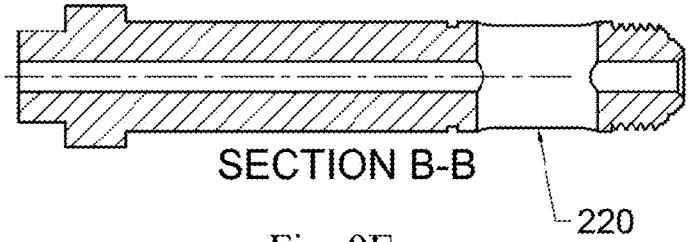
Figure 9A:
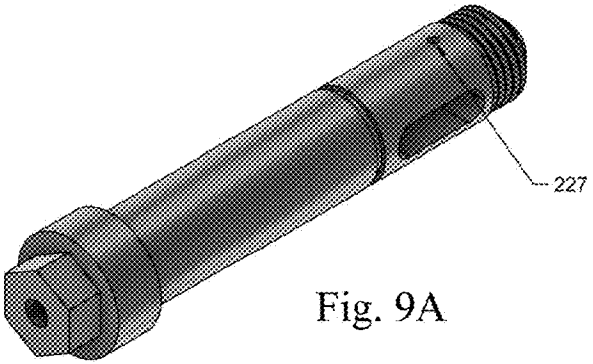
Figure 9C:
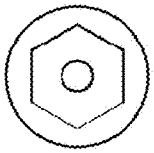
Figure 9D:
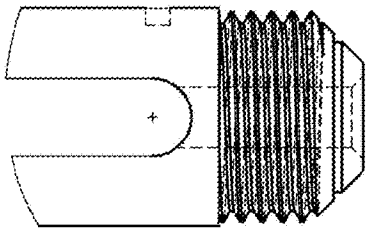

See, e.g., FIG. 9E.

Example 14. The system of Example 13, wherein the third aperture is fluidly coupled to the void included in the upper conduit via the first and second apertures.

Voids 218, 219 (FIG. 7A), 220 (FIG. 9E) may be needed to ensure well pressure is equalized across the tool post-detonation and plug shearing to help facilitate separation between the upper and lower conduits. For example, if well pressure has greater access to voids inside the tool via one plug over another plug (for whatever reason) the pressure may still equalize across the voids.

Second Example Set

Example 1. A system comprising: first and second conduits sliding coupled to one another without threads directly connecting the first and second conduits to one another; first and second endpieces, the first endpiece being coupled to the first conduit between the first conduit and a first downhole equipment portion and the second endpiece being coupled to the second conduit between the second conduit and a second downhole equipment portion; third and fourth conduits, wherein: (a) the third conduit is coupled, via threads, to the first conduit and the fourth conduit, and (b) the fourth conduit is coupled to the second conduit without threads directly connecting the fourth conduit to the second conduit; an intermediate conduit surrounding the fourth conduit and slidingly coupled to the fourth conduit without threads directly connecting the intermediate conduit to the fourth conduit; a plug included in a passage, the passage coupling an exterior surface of the first conduit to a void included in the first conduit; wherein: (a) a central axis traverses the first and second conduits, the first and second endpieces, and the first and fourth conduits, (b) an additional axis, which is parallel to the central axis, intersects the intermediate collar and a portion of the plug, the portion of the plug directly interfacing the void included in the first conduit.

Example 2. The system of Example 1 comprising an explosive charge and detonator assembly, wherein the assembly is at least partially included in a void included in the first endpiece.

Example 3. The system according to any of Examples 1-2, wherein: the first and second conduits are slidingly coupled to one another in a direction parallel to the central axis; the first and second conduits are keyed to one another via a key; the key obstructs rotation, about the central axis, of the first conduit with respect to the second conduit.

Example 4. The system according to any of Examples 1-3, wherein: the third conduit includes a threaded portion, a narrowed outer diameter portion, and a widened outer diameter portion; the narrowed outer diameter portion is between the threaded portion and the widened outer diameter portion.

Example 5. The system of Examples 2 and 4, wherein the narrowed outer diameter portion is configured to fracture in response to detonation of the explosive charge.

Example 6. The system of Example 4, wherein the third conduit includes at least one slot included in a wall that forms the widened outer diameter portion.

Example 7. The system of Example 6, wherein the slot includes a slot long axis that is parallel to the central axis.

Example 8. The system of Example 7, wherein the widened outer diameter portion is configured to spread radially away from the central axis in response to detonation of the explosive charge.

Example 9. The system according to any of Examples 1 to 8 comprising a first resilient member and a second resilient member, wherein the first resilient member retains at least a portion of the first endpiece within the first conduit and the second resilient member retains at least a portion of the second endpiece within the second conduit.

Example 10. The system according to any of Examples 1 to 9, wherein: the fourth conduit includes a rod shoulder that interfaces a conduit shoulder of the second conduit; another axis intersects the rod shoulder and the conduit shoulder.

Example 11. The system according to any of Examples 1 to 10, wherein at least a portion of the intermediate conduit is between the plug and at least a portion of the third conduit.

Example 12. The system according to any of Examples 1 to 11, wherein the intermediate conduit includes first and second apertures that each couple an outer surface of the intermediate conduit to an inner surface of the intermediate conduit.

Example 13. The system of Example 12 wherein the fourth conduit rod includes a third aperture that couples an outer surface of the fourth conduit to an inner surface of the fourth conduit.

Example 14. The system of Example 13, wherein the third aperture is fluidly coupled to the void included in the first conduit via the first and second apertures.

Third Example Set

Example 1. A system comprising: first and second conduits sliding coupled to one another without threads directly connecting the first and second conduits to one another; first and second endpieces, the first endpiece being coupled to the first conduit between the first conduit and a first downhole equipment portion and the second endpiece being coupled to the second conduit between the second conduit and a second downhole equipment portion; first and second bodies, wherein: (a) the first body is coupled, via threads, to the first conduit and the second body, and (b) the second body is coupled to the second conduit without threads directly connecting the second body to the second conduit; an intermediate member slidingly coupled to the second body without threads directly connecting the intermediate member to the second body; a plug included in a passage, the passage coupling an exterior surface of the first conduit to a void included in the first conduit; wherein: (a) a central axis traverses the first and second conduits, the first and second endpieces, and the first and second bodies, (b) an additional axis, which is parallel to the central axis, intersects the intermediate collar and a portion of the plug, the portion of the plug directly interfacing the void included in the first conduit.

Example 2. The system of Example 1 comprising an explosive charge and detonator assembly, wherein the assembly is at least partially included in a void included in the first endpiece.

Example 3. The system according to any of Examples 1-2, wherein: the first and second conduits are slidingly coupled to one another in a direction parallel to the central axis; the first and second conduits are keyed to one another via a key; the key obstructs rotation, about the central axis, of the first conduit with respect to the second conduit.

Example 4. The system according to any of Examples 1-3, wherein: the first body includes a threaded portion, a narrowed outer diameter portion, and a widened outer diameter portion; the narrowed outer diameter portion is between the threaded portion and the widened outer diameter portion.

Example 5. The system of Examples 2 and 4, wherein the narrowed outer diameter portion is configured to fracture in response to detonation of the explosive charge.

Example 6. The system of Example 4, wherein the first body includes at least one slot included in a wall that forms the widened outer diameter portion.

Example 7. The system of Example 6, wherein the slot includes a slot long axis that is parallel to the central axis.

Example 8. The system of Example 7, wherein the widened outer diameter portion is configured to spread radially away from the central axis in response to detonation of the explosive charge.

Example 9. The system according to any of Examples 1 to 8 comprising a first resilient member and a second resilient member, wherein the first resilient member retains at least a portion of the first endpiece within the first conduit and the second resilient member retains at least a portion of the second endpiece within the second conduit.

Example 10. The system according to any of Examples 1 to 9, wherein: the second body includes a shoulder that interfaces a shoulder of the second conduit; another axis intersects the shoulder of the second body and the should of the second conduit.

Example 11. The system according to any of Examples 1 to 10, wherein at least a portion of the intermediate member is between the plug and at least a portion of the second body.

Example 12. The system according to any of Examples 1 to 11, wherein the intermediate member includes first and second apertures that each couple an outer surface of the intermediate member to an inner surface of the intermediate member.

Example 13. The system of Example 12 wherein the second body includes a third aperture that couples an outer surface of the second body to an inner surface of the second body.

Example 14. The system of Example 13, wherein the third aperture is fluidly coupled to the void included in the first conduit via the first and second apertures.

Fourth Example Set

Example 1. A system comprising: first and second conduits sliding coupled to one another without threads directly connecting the first and second conduits to one another; first and second endpieces, the first endpiece being coupled to the first conduit between the first conduit and a first downhole equipment portion and the second endpiece being coupled to the second conduit between the second conduit and a second downhole equipment portion; first and second bodies, wherein: (a) the first body is coupled, via threads, to the first conduit and the second body, and (b) the second body is coupled to the second conduit without threads directly connecting the second body to the second conduit; a plug included in a passage, the passage coupling an exterior surface of the first conduit to a void included in the first conduit; wherein a central axis traverses the first and second conduits, the first and second endpieces, and the first and second bodies.

Thus, not all embodiments necessarily include a shearing ring and may instead rely on other portions (e.g., collar 8) to shear the plug or plugs.

Example 2. The system of Example 1 comprising an explosive charge and detonator assembly, wherein the assembly is at least partially included in a void included in the first endpiece.

Example 3. The system according to any of Examples 1-2, wherein: the first and second conduits are slidingly coupled to one another in a direction parallel to the central axis; the first and second conduits are keyed to one another via a key; the key obstructs rotation, about the central axis, of the first conduit with respect to the second conduit.

Example 4. The system according to any of Examples 1-3, wherein: the first body includes a threaded portion, a narrowed outer diameter portion, and a widened outer diameter portion; the narrowed outer diameter portion is between the threaded portion and the widened outer diameter portion.

Example 5. The system of Examples 2 and 4, wherein the narrowed outer diameter portion is configured to fracture in response to detonation of the explosive charge.

Example 6. The system of Example 4, wherein the first body includes at least one slot included in a wall that forms the widened outer diameter portion.

Example 7. The system of Example 6, wherein the slot includes a slot long axis that is parallel to the central axis.

Example 8. The system of Example 7, wherein the widened outer diameter portion is configured to spread radially away from the central axis in response to detonation of the explosive charge.

Example 9. The system according to any of Examples 1 to 8 comprising a first resilient member and a second resilient member, wherein the first resilient member retains at least a portion of the first endpiece within the first conduit and the second resilient member retains at least a portion of the second endpiece within the second conduit.

Example 10. The system according to any of Examples 1 to 9, wherein: the second body includes a shoulder that interfaces a shoulder of the second conduit; another axis intersects the shoulder of the second body and the should of the second conduit.

Fifth Example Set

Example 1. A system comprising: upper (207) and lower (206) conduits slidingly coupled to one another without threads directly connecting the upper and lower conduits to one another; upper (211) and lower (211') caps, the upper cap being coupled to the upper conduit between the upper conduit and a wireline portion and the lower cap being coupled to the lower conduit between the lower conduit and a tool string portion; upper (208) and lower (205) rods, wherein: (a) the upper rod is coupled, via threads, to the upper conduit and the lower rod, and (b) the lower rod is coupled to the lower conduit without threads directly connecting the lower rod to the lower conduit; an intermediate conduit (201) surrounding the lower rod and slidingly coupled to the lower rod without threads directly connecting the intermediate conduit to the lower rod; a plug (202) included in a passage (239), the passage coupling an exterior surface of the upper conduit to a void (210) included in the upper conduit; wherein: (a) a central axis 212 traverses the upper and lower conduits, the upper and lower caps, and the upper and lower rods, (b) an additional axis (213), which is parallel to the central axis, intersects the intermediate conduit and a portion of the plug, the portion of the plug directly interfacing the void included in the upper conduit.

Example 2. The system of Example 1 comprising an explosive charge and detonator assembly, wherein the assembly is at least partially included in a void (212') included in the upper cap.

Example 3. The system according to any of Examples 1-2, wherein: the upper and lower conduits are slidingly coupled to one another in a direction parallel to the central axis; the upper and lower conduits are keyed to one another via a key (203); the key obstructs rotation, about the central axis, of the upper conduit with respect to the lower conduit.

Example 4. The system according to any of Examples 2-3, wherein: the upper rod includes a threaded portion, a narrowed outer diameter (214) portion, and a widened outer diameter (215) portion; the narrowed outer diameter portion is between the threaded portion and the widened outer diameter portion.

Example 5. The system of Example 4, wherein the narrowed outer diameter portion is configured to fracture in response to detonation of the explosive charge.

Example 6. The system of Example 4, wherein the upper rod includes at least one slot (216) included in a wall that forms the widened outer diameter portion.

Example 7. The system of Example 6, wherein the slot includes a slot long axis that is parallel to the central axis.

Example 8. The system of Example 7, wherein the widened outer diameter portion is configured to spread radially away from the central axis in response to detonation of the explosive charge.

Example 9. The system according to any of Examples 1 to 8 comprising an upper resilient member (18) and a lower resilient member (17), wherein the upper resilient member retains at least a portion of the upper cap within the upper conduit and the lower resilient member retains at least a portion of the lower cap within the lower conduit.

Example 10. The system according to any of Examples 1 to 9, wherein: the lower rod includes a lower rod shoulder that interfaces a lower conduit shoulder of the lower conduit; another axis (217) intersects the lower rod shoulder and the lower conduit shoulder.

Example 11. The system according to any of Examples 1 to 10, wherein at least a portion of the intermediate conduit is between the plug and at least a portion of the upper rod.

Example 12. The system according to any of Examples 1 to 11, wherein the intermediate conduit includes first and second apertures (218, 219) that each couple an outer surface of the intermediate conduit to an inner surface of the intermediate conduit.

Example 13. The system of Example 12 wherein the bottom rod includes a third aperture (220) that couples an outer surface of the lower rod to an inner surface of the lower rod.

Example 14. The system of Example 13, wherein the third aperture is fluidly coupled to the void included in the upper conduit via the first and second apertures.

Example 15. A system comprising: first and second conduits sliding coupled to one another without threads directly connecting the first and second conduits to one another; first and second endpieces, the first endpiece being coupled to the first conduit between the first conduit and a first downhole equipment portion and the second endpiece being coupled to the second conduit between the second conduit and a second downhole equipment portion; third and fourth conduits, wherein: (a) the third conduit is coupled, via threads, to the first conduit and the fourth conduit, and (b) the fourth conduit is coupled to the second conduit without threads directly connecting the fourth conduit to the second conduit; an intermediate conduit surrounding the fourth conduit and slidingly coupled to the fourth conduit without threads directly connecting the intermediate conduit to the fourth conduit; a plug included in a passage, the passage coupling an exterior surface of the first conduit to a void included in the first conduit; wherein: (a) a central axis traverses the first and second conduits, the first and second endpieces, and the first and fourth conduits, (b) an additional axis, which is parallel to the central axis, intersects the intermediate conduit and a portion of the plug, the portion of the plug directly interfacing the void included in the first conduit.

Example 16. The system of Example 15 comprising an explosive charge and detonator assembly, wherein the assembly is at least partially included in a void included in the first endpiece.

Example 17. The system according to any of Examples 15-16, wherein: the first and second conduits are slidingly coupled to one another in a direction parallel to the central axis; the first and second conduits are keyed to one another via a key; the key obstructs rotation, about the central axis, of the first conduit with respect to the second conduit.

Example 18. The system according to any of Examples 15-16, wherein: the third conduit includes a threaded portion, a narrowed outer diameter portion, and a widened outer diameter portion; the narrowed outer diameter portion is between the threaded portion and the widened outer diameter portion.

Example 19. The system of Example 18, wherein the narrowed outer diameter portion is configured to fracture in response to detonation of the explosive charge.

Example 20. The system of Example 18, wherein the third conduit includes at least one slot included in a wall that forms the widened outer diameter portion.

The foregoing description of the embodiments of the invention has been presented for the purposes of illustration and description. It is not intended to be exhaustive or to limit the invention to the precise forms disclosed. This description and the claims following include terms, such as left, right, top, bottom, over, under, upper, lower, first, second, etc. that are used for descriptive purposes only and are not to be construed as limiting. For example, terms designating relative vertical position refer to a situation where a side of a substrate is the "top" surface of that substrate; the substrate may actually be in any orientation so that a "top" side of a substrate may be lower than the "bottom" side in a standard terrestrial frame of reference and still fall within the meaning of the term "top." The term "on" as used herein (including in the claims) does not indicate that a first layer "on" a second layer is directly on and in immediate contact with the second layer unless such is specifically stated; there may be a third layer or other structure between the first layer and the second layer on the first layer. The embodiments of a device or article described herein can be manufactured, used, or shipped in a number of positions and orientations. Persons skilled in the relevant art can appreciate that many modifications and variations are possible in light of the above teaching. Persons skilled in the art will recognize various equivalent combinations and substitutions for various components shown in the Figures. It is therefore intended that the scope of the invention be limited not by this detailed description, but rather by the claims appended hereto.

What is claimed is:

1. A system comprising:

upper and lower conduits slidingly coupled to one another without threads directly connecting the upper and lower conduits to one another;

upper and lower caps, the upper cap being coupled to the upper conduit between the upper conduit and a wireline portion and the lower cap being coupled to the lower conduit between the lower conduit and a tool string portion;

upper and lower rods, wherein: (a) the upper rod is coupled, via threads, to the upper conduit and the lower rod, and (b) the lower rod is coupled to the lower conduit without threads directly connecting the lower rod to the lower conduit;

an intermediate conduit surrounding the lower rod and slidingly coupled to the lower rod without threads directly connecting the intermediate conduit to the lower rod;

a plug included in a passage, the passage coupling an exterior surface of the upper conduit to a void included in the upper conduit;

an explosive charge and detonator assembly that is at least partially included in a void included in the upper cap;

wherein: (a) a central axis traverses the upper and lower conduits, the upper and lower caps, and the upper and lower rods, (b) an additional axis, which is parallel to the central axis, intersects the intermediate conduit and a portion of the plug, the portion of the plug directly interfacing the void included in the upper conduit.

2. The system of claim 1, wherein:

the upper and lower conduits are slidingly coupled to one another in a direction parallel to the central axis;

the upper and lower conduits are keyed to one another via a key;

the key obstructs rotation, about the central axis, of the upper conduit with respect to the lower conduit.

3. The system of claim 1, wherein:

the upper rod includes a threaded portion, a narrowed outer diameter portion, and a widened outer diameter portion;

the narrowed outer diameter portion is between the threaded portion and the widened outer diameter portion.

4. The system of claim 3, wherein the narrowed outer diameter portion is configured to fracture in response to detonation of an explosive charge.

5. The system of claim 3, wherein the upper rod includes at least one slot included in a wall that forms the widened outer diameter portion.

6. The system of claim 5, wherein the slot includes a slot long axis that is parallel to the central axis.

7. The system of claim 6, wherein the widened outer diameter portion is configured to spread radially away from the central axis in response to detonation of the explosive charge.

8. The system of claim 1 comprising an upper resilient member and a lower resilient member, wherein the upper resilient member retains at least a portion of the upper cap within the upper conduit and the lower resilient member retains at least a portion of the lower cap within the lower conduit.

9. The system of claim 1, wherein:

the lower rod includes a lower rod shoulder that interfaces a lower conduit shoulder of the lower conduit;

another axis intersects the lower rod shoulder and the lower conduit shoulder.

10. The system of claim 1, wherein at least a portion of the intermediate conduit is between the plug and at least a portion of the upper rod.

11. The system of claim 1, wherein the intermediate conduit includes first and second apertures that each couple an outer surface of the intermediate conduit to an inner surface of the intermediate conduit.

12. The system of claim 11 wherein the lower rod includes a third aperture that couples an outer surface of the lower rod to an inner surface of the lower rod.

13. The system of claim 12, wherein the third aperture is fluidly coupled to the void included in the upper conduit via the first and second apertures.

14. A system comprising:

first and second conduits sliding coupled to one another without threads directly connecting the first and second conduits to one another;

first and second endpieces, the first endpiece being coupled to the first conduit between the first conduit and a first downhole equipment portion and the second endpiece being coupled to the second conduit between the second conduit and a second downhole equipment portion;

third and fourth conduits, wherein: (a) the third conduit is coupled, via threads, to the first conduit and the fourth conduit, and (b) the fourth conduit is coupled to the second conduit without threads directly connecting the fourth conduit to the second conduit;

an intermediate conduit surrounding the fourth conduit and slidingly coupled to the fourth conduit without threads directly connecting the intermediate conduit to the fourth conduit;

a plug included in a passage, the passage coupling an exterior surface of the first conduit to a void included in the first conduit;

wherein: (a) a central axis traverses the first and second conduits, the first and second endpieces, and the third and fourth conduits, (b) an additional axis, which is parallel to the central axis, intersects the intermediate conduit and a portion of the plug, the portion of the plug directly interfacing the void included in the first conduit;

wherein at least a portion of the intermediate conduit is between the plug and at least a portion of the third conduit.

15. The system of claim 14 comprising an explosive charge and detonator assembly, wherein the assembly is at least partially included in a void included in the first endpiece.

16. The system of claim 14, wherein:

the first and second conduits are slidingly coupled to one another in a direction parallel to the central axis;

the first and second conduits are keyed to one another via a key;

the key obstructs rotation, about the central axis, of the first conduit with respect to the second conduit.

17. The system of claim 16, wherein:

the third conduit includes a threaded portion, a narrowed outer diameter portion, and a widened outer diameter portion;

the narrowed outer diameter portion is between the threaded portion and the widened outer diameter portion.

18. The system of claim 17, wherein the narrowed outer diameter portion is configured to fracture in response to detonation of an explosive charge.

19. The system of claim 17, wherein the third conduit includes at least one slot included in a wall that forms the widened outer diameter portion.

20. A system comprising:

first and second conduits sliding coupled to one another without threads directly connecting the first and second conduits to one another;

first and second endpieces, the first endpiece being coupled to the first conduit between the first conduit and a first downhole equipment portion and the second endpiece being coupled to the second conduit between the second conduit and a second downhole equipment portion;

third and fourth conduits, wherein: (a) the third conduit is coupled, via threads, to the first conduit and the fourth conduit, and (b) the fourth conduit is coupled to the second conduit without threads directly connecting the fourth conduit to the second conduit;

an intermediate conduit surrounding the fourth conduit and slidingly coupled to the fourth conduit without threads directly connecting the intermediate conduit to the fourth conduit;

a plug included in a passage, the passage coupling an exterior surface of the first conduit to a void included in the first conduit;

wherein: (a) a central axis traverses the first and second conduits, the first and second endpieces, and the first and fourth conduits, (b) an additional axis, which is parallel to the central axis, intersects the intermediate conduit and a portion of the plug, the portion of the plug directly interfacing the void included in the first conduit;

wherein (a) the fourth conduit includes a fourth conduit shoulder that interfaces a second conduit shoulder of the second conduit, and (b) another axis intersects the fourth conduit shoulder and the second conduit shoulder.

21. The system of claim 20 comprising an explosive charge and detonator assembly, wherein the assembly is at least partially included in a void included in the first endpiece.

22. The system of claim 20, wherein:

the first and second conduits are slidingly coupled to one another in a direction parallel to the central axis;

the first and second conduits are keyed to one another via a key;

the key obstructs rotation, about the central axis, of the first conduit with respect to the second conduit.

23. The system of claim 22, wherein:

the third conduit includes a threaded portion, a narrowed outer diameter portion, and a widened outer diameter portion;

the narrowed outer diameter portion is between the threaded portion and the widened outer diameter portion.

24. The system of claim 23, wherein the narrowed outer diameter portion is configured to fracture in response to detonation of an explosive charge.

25. The system of claim 23, wherein the third conduit includes at least one slot included in a wall that forms the widened outer diameter portion.

* * * * *